United States Patent [19]

La Rovere

[11] Patent Number: 4,856,176

[45] Date of Patent: Aug. 15, 1989

[54] PROCESS AND APPARATUS FOR ASSEMBLING A TUBULAR CONTAINER

[75] Inventor: Ruggiero La Rovere, Rio de Janeiro, Brazil

[73] Assignee: Rheem Empreendimentos Industriais E. Comerciais S/A, Rio de Janeiro, Brazil

[21] Appl. No.: 72,513

[22] Filed: Jul. 13, 1987

[30] Foreign Application Priority Data

Nov. 21, 1986 [BR] Brazil ..... PI 8605741[U]

[51] Int. Cl.[4] ..... B21D 39/00; B23P 11/00

[52] U.S. Cl. ..... 29/511; 29/509; 29/709

[58] Field of Search ..... 29/505, 506, 509, 510, 29/511, 709; 220/67

[56] References Cited

U.S. PATENT DOCUMENTS 3,802,050 4/1974 Verhoest ..... 29/511 X 4,546,529 10/1985 Leon ..... 29/511 X 4,697,972 10/1987 LeBret et al. ..... 29/509 X

*Primary Examiner*—Timothy V. Eley

*Attorney, Agent, or Firm*—Birch, Stewart, Kolasch & Birch

[57] ABSTRACT

The present invention refers to a process for the manufacture of a basically cylindrical container provided with a can end which is lock-seamed to a longitudinally welded body without the risk of scratching the inside of the can body, by providing a sequence of operations which is adapted to high volume production, including the steps of preparation of the can body, preparation of the can tap, seating of the tap or can end, moving the can body, applying an axial force to the body wall, and transferring of the can body with the can end to a final lock seaming operation.

The present invention further describes apparatus associated to the new steps of the process as well as to a specific machine for lock seaming which includes such devices, and to a can end to be lock seamed by the process.

12 Claims, 6 Drawing Sheets

PRIOR ART

PRIOR ART

PROCESS AND APPARATUS FOR ASSEMBLING A TUBULAR CONTAINER

BACKGROUND AND SUMMARY OF THE INVENTION

The present invention is directed to a process for lock seaming a cap to one end of a metal body to form a basically cylindrical container and also to an apparatus for use in such a process.

Brazilian Patent Application BR PI 8405613 of Nov. 1, 1986 shows a container, commonly referred to as a can, for packaging a solid or liquid products, in which an end cap is joined to a metal body, and longitudinally welded, by means of a lock seam having body and end hooks in a perpendicular plane to the axis of the body. The patent application also describes a process by which this container can be produced. The objective of the present invention is to show a more advantageous process, especially for lock seaming ends of cylindrical metal bodies, and devices pertaining to said process.

DESCRIPTION OF THE DRAWINGS

The present invention will become more fully understood from the detailed description given hereinbelow and the accompanying drawings which are given by way of illustration only, and thus, are not limitative of the present invention, and wherein.

Figure 1:
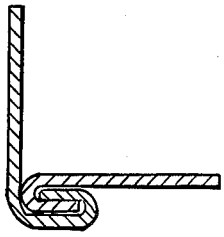
FIG. 1 shows a cross sectional view of the seam as described in patent application BR PI 8405613.

In the process described in patent application BR PI 8405613, the end cap to be lock seamed is lifted through one opening of the container body up to the other side by a suitable lifter, and the end's edges are engaged in the edge of the body which was previously folded toward the inside part of said can body, at an angle of 180°. Afterwards, by applying axial force, the folded part of the body and the edge of the end are formed together to make a lock seam as shown in FIG. 1. This process creates the problem that, while passing through the body, the end's edges may scratch the inside surface (generally varnished) of the body. Also, it is necessary that the body edge be folded prior to the seam-locking operation.

The directed present invention is to a new process for manufacturing a basically cylindrical container with an end cap lock-seamed to a longitudinally welded body, without the risk of scratching inside of the can body, and providing a sequence of operations that can be easily adapted to high volume production. The resulting lock seam is similar to the one described in Patent Application BR PI 8405613 and also shows suitable means and devices for high volume production of such containers. The process consists of the following operations:

(A) A cylindrical metal can body is prepared by known devices, in which the longitudinal seam is welded by electrical resistance. (FIGS. 3–9).

Figure 2:
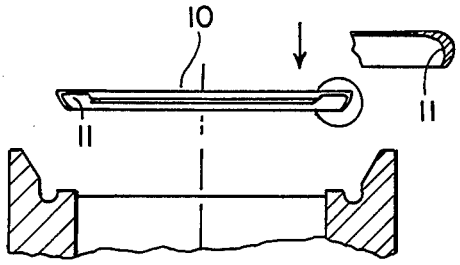
FIGS. 2, 3, 4, and 5 are cross sectional views of the sequence of the new process.

(B) A round cap with a downfolded edge is prepared, said edge forming a cylindrical or slightly conical surface (FIGS. 2, element 10). The center panel of the end may protrude to increase rigidity. A ring of sealing material (11) is applied to the inside surface of the end's downfolded edge, to make a leak-proof seal when engaged by the edge of the can body.

Figure 3:
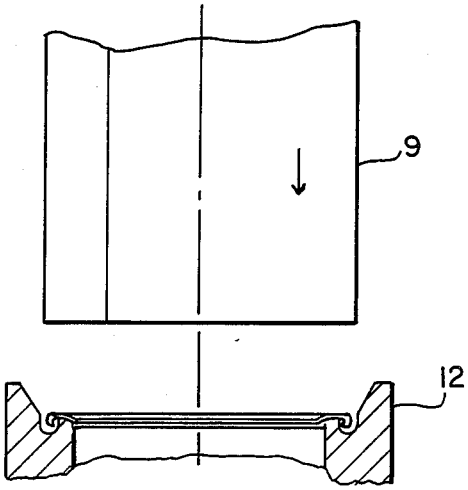

(C) The above mentioned end with edges turned downward is seated on a suitably profiled forming tool of a seam locking device (FIG. 3, element 12).

(D) The above mentioned can body is moved downward into the seam locking device in an axial direction, till it passes over the edge of the end and comes to rest on the forming tool (FIG. 3), with the inside surface of the lower edge of the can body adjoining the outside cylindrical surface of the end.

Figure 4:
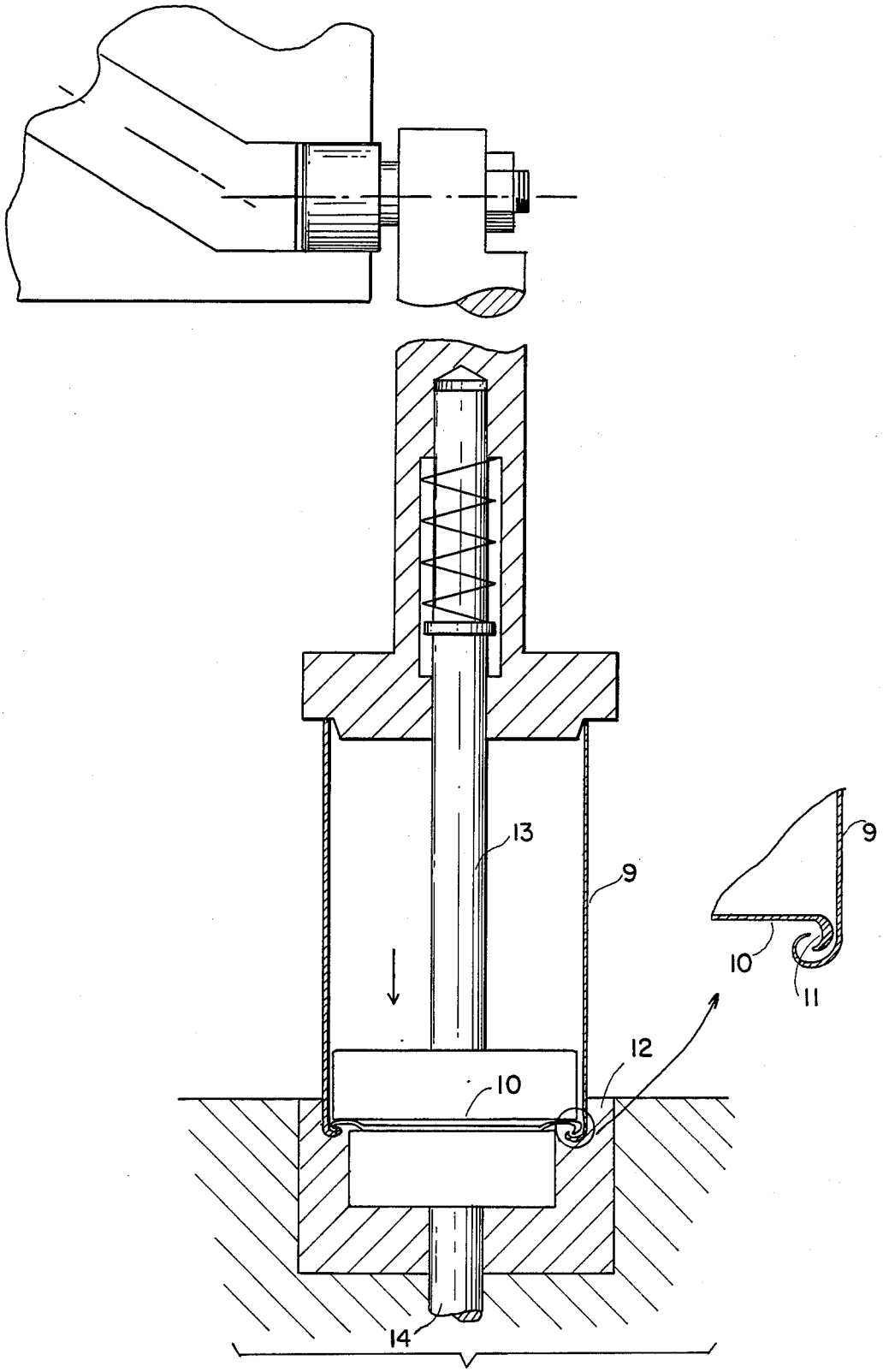

(E) An axial force is applied to the body wall, forcing the lower edges of said wall to curl around the cylindrical part of the can end until they become engaged with the sealing material on the inside of the end's cylindrical surface (FIG. 4). During this operation an inside rod (13) applies spring pressures on the end to avoid movement. At the end of this operation, which is called the "first seaming operation", a knock-out plate (14) lifts the end out of the forming tool.

(F) The can body with the partially locked end is transferred to another device (FIG. 5), where the partially formed edge on the lower part of the can body is seated on a suitably profiled tool (16). A circular hammer (15) will move downward to apply pressure to shape the lock seam into its final profile, by reaction against the fixed tool (16). The lock seam is made leak-proof by the force applied by the adjacent surfaces of the can end and the can body to the ring of elastic sealing material. The above operation is called the "second seaming operation".

Figure 6:
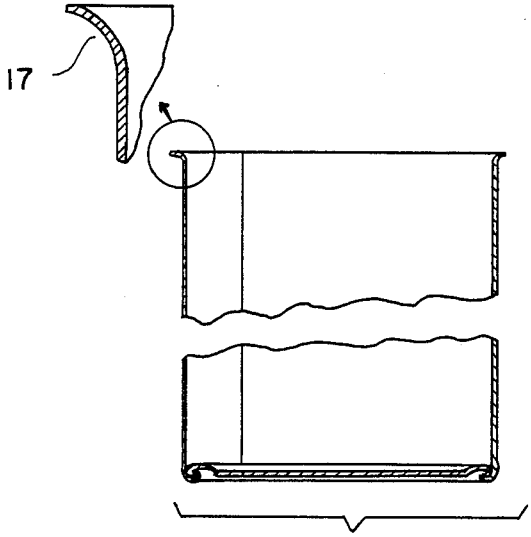
FIG. 6 is a cross sectional view showing a detail of the upper part of the can body.

(G) In some cases it may be desirable that the body edge on the opposite side from the lock seam be bent outwards to form a flange (17), to which an end may be joined, after filling the container by means commonly used in the can industry (FIG. 6). In this case the device, described in (C), (D) and (E) above, will be provided on the upper side with a flanging tool (19), of a type commonly used in the industry, the novelty of the device being its working in connection with the forming tool of the first seaming operation (FIG. 6). The reaction to the axial force producing the curling of the body edge described in (E) will force the upper edge to open in a flange form, till it hits the stop ring (18), which limits the operation. This stop ring has a spring action, and it works as an extractor when the device lifts after the first seaming operation.

Figure 7:
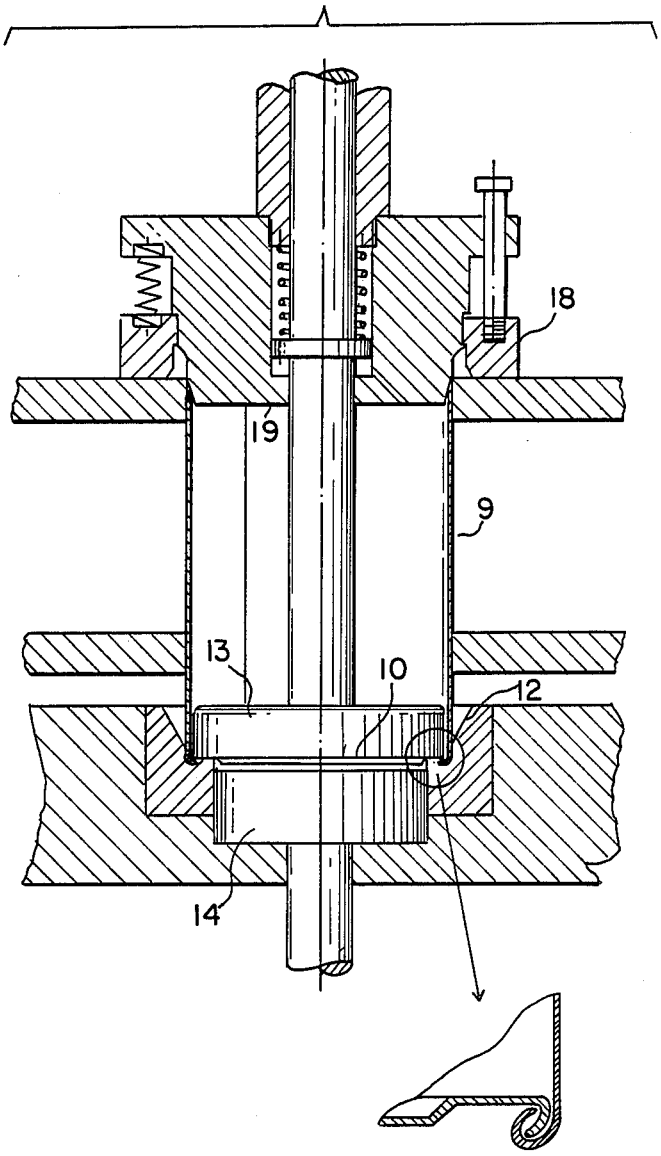
FIG. 7 is a cross sectional view showing a preferred design of the device which performs the first operation of the new lock-seaming process.
Figure 8:
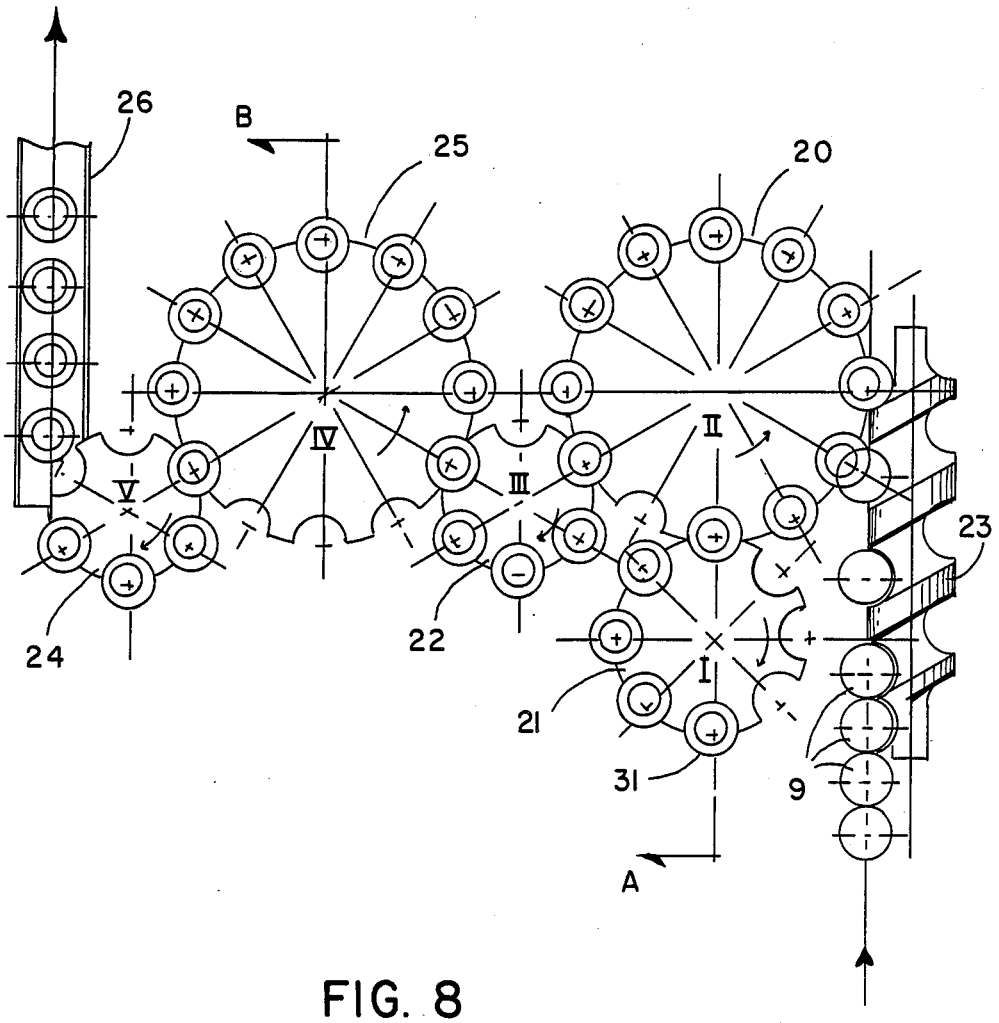
FIG. 8 is a schematic lay-out of a system utilized for mass production of lock-seamed containers.
Figure 9:
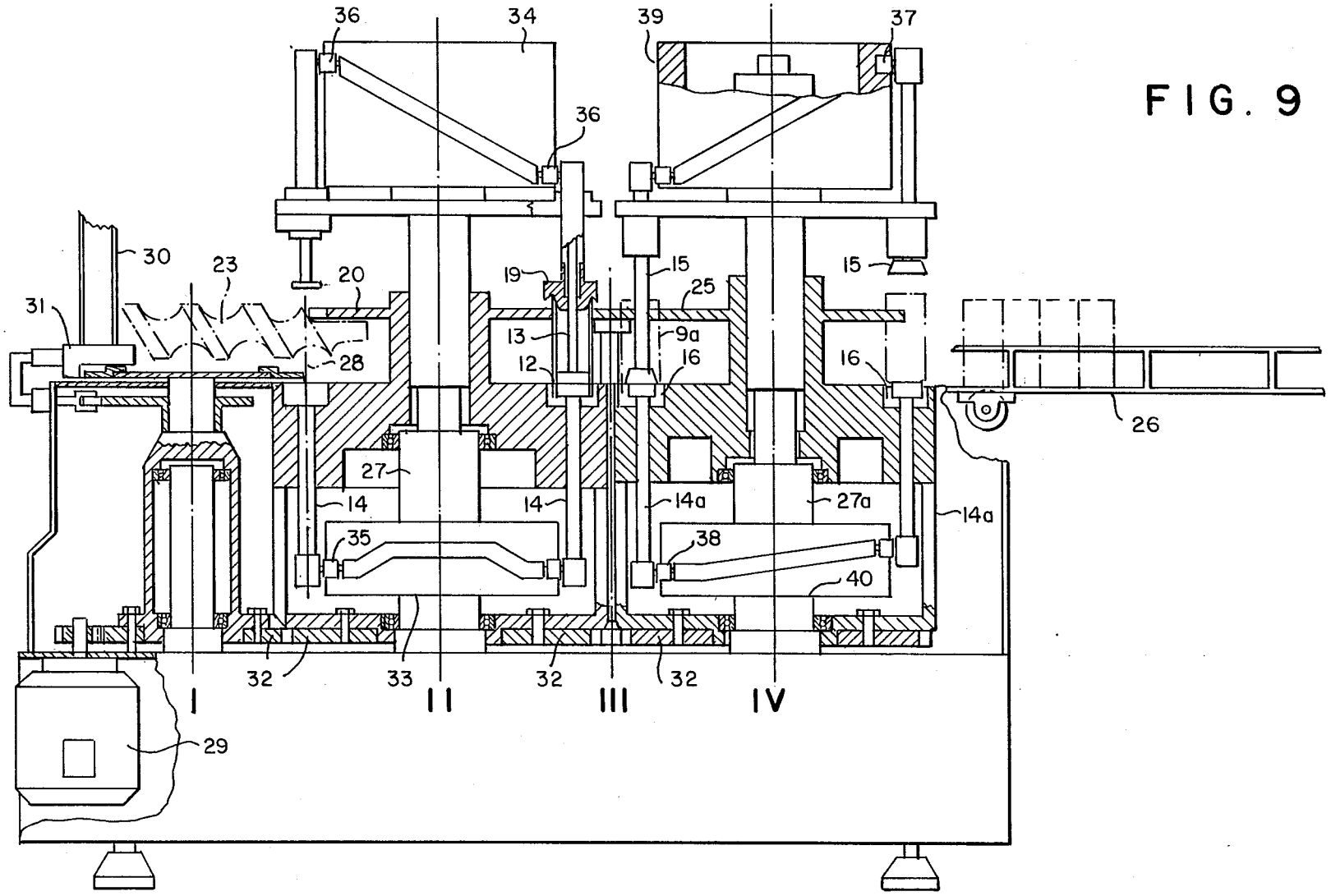
FIG. 9 is a schematic cross section, non-proportional, of the device shown in FIG. 8, made along lines A–I–II–IV–B shown in FIG. 8.

For mass production, the devices used in the above process may be applied to a machine shown in FIG. 8, that shows a schematic view from above and FIG. 9, which shows a cross section of the machine along the line A–I–II–IV–B shown in FIG. 8. This type of machine is well known in the industry, under the name of "Canomat", the novelty being the combination of the forming devices described in paragraphs (A) to (G) above and shown in FIGS. 4, 5, 6 and 7.

In the proposed assembly, (see FIGS. 8 and 9) wheel 21 is used to transfer ends from a destacking device (31) to wheel (20), by processes and devices (28) already known that hold ends peripherally on wheel (21). On the point of tangency of wheel (21) to wheel (20), the ends are transferred to wheel (20), on top of tools (12) mounted there. On wheel (20) are peripherically assembled several devices of the type described in paragraphs (C), (D), (E) and (G) (FIGS. 4 and 7), the vertical movement of parts of said devices being provided by cam followers (35) and (36) running on fixed circumferential cams located concentrically under and above said wheel (20). Linear feeder (23) is of the plastic screw type commonly used to feed cylindrical bodies onto rotating devices. On wheel (25) are assembled peripherically several devices described in paragraph (F) and shown in FIG. 5 (15–16), in which vertical movements are provided by cam followers (37) and (38) running on fixed circumferential cams. Wheels (22) and (24) are transfer wheels that, by known devices such as spring loaded holders or magnets, pick up cans at tangency points and transfer then from wheel (20) to wheel (25), or from wheel (25) to linear conveyor (26). Conveyor (26) is used to take bodies with lock-seamed ends away from the machine. Wheels (21), (20), (22), (24), (25) and screw (23) are linked by gears (32) placed under the wheels in order to assure a synchronized movement and moved by one single motor (29), which is in such machines.

The machine operation is a follows:

(1) Can ends from a destacker (31) are carried by wheel (21) towards wheel (20), and, at the point of tangency, between wheel 21 and wheel 20 the can ends are dropped over lifter (14), (by action of roller (35) in lower cam (33), then lowered into forming ring (12) as shown in FIG. 2 (8 and 9). The operation is continuous, each forming device on the periphery of wheel (20) receiving one can end.

(2) By means of endless screw (23), a metal body (9) is transferred to the peripherically mounted forming device (12, 13, 14, 19) in wheel (20), where said body is held, by means of side mounted springs or magnets, concentrically above the can end which are already sitting on the forming tool (12) (FIG. 3).

(3) As wheel (20) progresses in its circular travel rollers (36) linked to part (19), that roll over a circular, fixed cam (34) mounted on the upper part of the machine, element (19) is moved downwards by action of the cam's profile, forcing the body against forming tool (12), to complete the first seaming operation.

Figure 5:
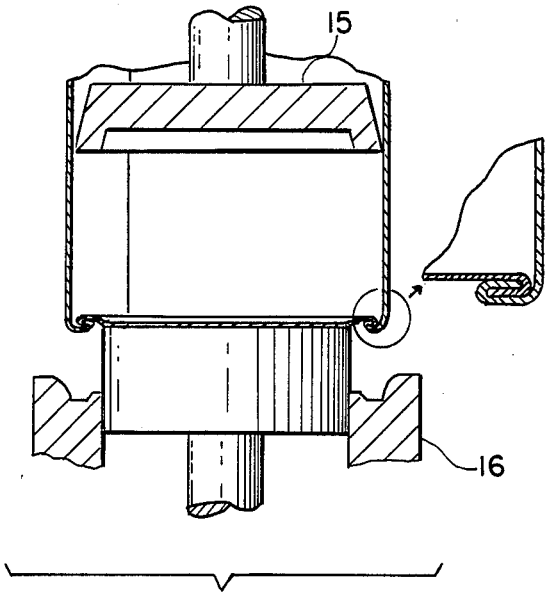

(4) Continuing its circular motion, wheel (20) will become tangent to wheel (22). At the tangency point the body with the partially seamed end, is transferred to the cavity on wheel (22) and is held (by springs or magnets) till by the circular movement of said wheel (22), it becomes tangent to wheel (25). At this point it is removed to a peripherically mounted forming device (16) assembled to wheel (25), and placed above a forming tool as shown in FIG. 5. Soon thereafter, by action of a roller (37) running over a cam (39) fixed to the upper point of the machine, hammer (15) is lowered inside the container body and presses the bottom end against tool (16), processing the final tightening of the seam. The seamed can is then ejected from tool (16) by vertical movement of part (14*a*) driven by roller (38) running in lower cam (40). All the devices described above, of wheels synchronized with feeders and to each other, for transferring ends and bodies from one wheel to the other, and tools moving vertically by roller and cam action are all known in the can making industry. The novelty of the machine consists in its use with devices as shown in FIG. 4, FIG. 5 and FIG. 7 of the present application.

It should be further noted that the can end is somewhat similar to a conventional end. It has a coating lacquer on one side, intended to prevent contact between the canned product and the end metal and the lining compound (FIG. 2, element 11) on the other side (outside) which is different from what is seen in conventional can ends in which the lining compound is applied to the same side (inside) where the coating lacquer is applied. The container annular wall allows for centering onto a support tool not providing for the function of radial support of a conventional seaming mandrel, movement of the body up to the end and past the same to form a down turned edge and the ability of flanging the upper end of the body by means of a stop or abutment ring and thereafter urging the lower end into the seaming die profile, are also characteristic features of the invention.

The invention being thus described, it will be obvious that the same may be varied in many ways. Such variations are not to be regarded as a departure from the spirit and scope of the invention and all such modifications as would be obvious to one skilled in the art are intended to be included within the scope of the following claims.

I claim:

1. A process for lock seaming one circular can end to a tubular member to form a cylindrical container, said tubular member being preliminarily formed from a flat sheet into a tubular shape with a welded vertical seam and said circular can end having a substantially planar configuration with turned down peripheral edge portions, the inside corner of the turned down edge portions containing an elastic material, said process comprising the steps of:

(a) placing the circular can end having its peripheral edge turned in the downward direction, in a device having in its lower portion a suitably profiled forming tool, (b) placing the tubular shaped member in said device in such a manner that it stands concentrically over the can end, (c) vertically lowering the tubular shaped member until it contacts the can end so that the inside surface of the lower edge of said tubular member touches the outside peripheral surface of the can end, (d) applying a downward vertical force to said tubular shaped member until said member's lower edge end is forced by contact with the forming tool (12), to curl inward, around the can end's cylindrical edge, until it contacts the elastic material previously applied to the inner surface of said cylindrical edge, thus completing a "first seaming operation", and (e) transferring the tubular shaped member with its partially seamed end to a second suitably shaped device and pressing the partially seamed end with the inwardly curled edge portion against said shaped device to form the adjoining parts of said tubular member and said can end into a final shape, thus concluding a second seaming operation.

2. The process as described in claim 1, wherein the reaction to the downward vertical forming force axially applied to the tubular shaped member, during the first seaming operation, causes the opposite edge from the edge of the body where the seaming operation is processed, to flare in the outward direction, forming a flange therein.

3. The process of claim 1, wherein the tubular member is made of a metal material.

4. A continuous process for lock seaming, in sequence, a plurality of can ends to corresponding tubular shaped members to form cylindrical containers, said tubular shaped members being preliminary formed from a flat sheet into said tubular shape with a welded vertical seam and said circular can ends having a substantially planar configuration with turned down peripheral edge portions, the inside corner of the turned down edge portions containing an elastic material, said process comprising the steps of:

(a) placing, in sequence, the circular can ends having their peripheral edge turned in the downward direction, in a device having in its lower portion a suitably profiled forming tool, (b) placing, in sequence, the tubular shaped members in said device in such a manner that they stand concentrically over the can ends, (c) vertically lowering, in sequence, the tubular shaped members until they contact the can ends so that the inside surface of the lower edge of said tubular shaped members touch the outside peripheral surface of the can end, (d) applying, in sequence, a downward vertical force to said tubular shaped members until said members lower edge ends are forced by contact with the forming tool (12), to curl inward, around the can end's cylindrical edge, until it contacts the elastic material previously applied to the inner surface of said cylindrical edge, thus completing a first seaming operation, and (e) transferring, in sequence, each of the tubular shaped members with their partially seamed ends to a second suitably shaped device and pressing, in sequence, the partially seamed ends with the inwardly curled edge portions against said shaped device to form the adjoining parts of said tubular member and said can ends into a final shape, thus concluding a second seaming operation.

5. The process as described in claim 4, wherein the reaction to the downward vertical forming force axially supplied to the tubular shaped members, during the first seaming operation, causes the opposite edge from each edge of the body where the seaming operation is processed, to flare in the outward direction, forming a flange therein.

6. The process of claim 4, wherein the tubular member is made of a metal material.

7. An apparatus for lock seaming one can end to a tubular shaped member to form a cylindrical container which comprises a first profiled forming device having a circular configuration, said forming device being provided with a peripheral groove, means for placing a circular can end having its peripheral edge turned in the downward direction in said profiled forming device so that said peripheral edge extends into said peripheral groove, means for placing one end of a tubular shaped member into said peripheral groove along the outside peripheral surface of the circular, turned down, can end, means for applying a downward, vertical force to the tubular shaped member so that the end of the tubular shaped member is forced to curl inward around the edge of the circular can end to form a tubular shaped member with a partially seamed end, means for transferring the tubular shaped member with its partially seamed end to a second profiled forming device containing a peripheral groove, said partially seamed end extending into said peripheral groove, and means for pressing the partially seamed end with the inwardly curled edge portion against said second profiled forming device to form the adjoining parts of said tubular body and said cam end into a final shape in the second seaming operation.

8. The apparatus of claim 7, wherein a flanging member is operatively associated with the first profiled forming device so that when the downward, vertical force is applied to the tubular shaped member during the first seaming operation, the opposite edge of the tubular body from the seaming operation is caused to flare in the outward direction, forming a flange therein.

9. The apparatus of claim 7, werein an elastic material is disposed at the inside corner of the turned down edge portion of the can end.

10. A continuous apparatus for lock seaming, in sequence, a plurality of can ends to corresponding tubular shaped members to continuously form cylindrical containers which comprise:

a first profiled forming device containing a plurality of circular forming stations, each provided with a peripheral groove, means for placing, in sequence, a plurality of circular can ends having peripheral turned down edges into each of said circular forming statons so that the peripheral edge of each can end extends into a corresponding peripheral groove of said forming device, means for placing, in sequence, one end of a tubular shaped member into each of said peripheral grooves along the outside peripheral surface of the circular, turned down can end, means for applying, in sequence, a downward force to each of the tubular shaped members so that the end of each of said tubular shaped members is forced to curl inward around the edge of the circular can end to form a tubular shaped member with a partially seamed end, means for transferring, in sequence, each of the tubular shaped members with its partially seamed end to a second profiled forming device containing a plurality of circular forming stations, each provided with a peripheral groove, said partially seamed end extending into said peripheral groove, and means for applying, in sequence, a downward force to each of the partially seamed ends to press the inwardly curled edge portions against said second profiled forming device to form the adjoining parts of said tubular body and said can end into a final seamed can end.

11. The apparatus of claim 10, wherein a flanging member is operatively associated with the first profiled forming device so that when the downward, vertical force is applied to each of the tubular shaped members during the first seaming operation, the opposite edge of the tubular body from the seaming operation is caused to flare in the outward direction, forming a flange therein.

12. The apparatus of claim 10, wherein an elastic material is disposed at the inside corner of the turned down edge portion of the can end.

* * * * *